US005339791A

United States Patent [19]

Sullivan

[11] Patent Number: 5,339,791

[45] Date of Patent: Aug. 23, 1994

[54] GAS POWERED GUN

[76] Inventor: Brian Sullivan, 517 N. Mountain Ave., Upland, Calif. 91786

[21] Appl. No.: 55,640

[22] Filed: Apr. 30, 1993

Related U.S. Application Data

[63] Continuation-in-part of Ser. No. 916,527, Jul. 20, 1992, Pat. No. 5,257,614.

[51] Int. Cl.[5] ..... F41B 11/06

[52] U.S. Cl. ..... 124/73; 124/74

[58] Field of Search ..... 124/73, 74, 70–72, 124/75, 76, 56, 65–67

[56] References Cited

U.S. PATENT DOCUMENTS

| | | | |
|---|---|---|---|
| 964,810 | 7/1910 | Rieger | 124/65 |
| 3,199,501 | 8/1965 | Bertschinger | 124/74 X |
| 3,204,625 | 9/1965 | Shepherd . | |
| 3,494,344 | 2/1970 | Vadas et al. . | |
| 3,572,310 | 3/1971 | Chiba . | |
| 3,788,298 | 1/1974 | Hale . | |
| 4,531,503 | 7/1985 | Shepherd . | |
| 4,936,282 | 6/1990 | Dobbins et al. . | |
| 5,078,118 | 1/1992 | Perrone | 124/74 |

FOREIGN PATENT DOCUMENTS

| | | | |
|---|---|---|---|
| 1264128 | 1/1990 | Canada | 124/67 |

*Primary Examiner*—Randolph A. Reese
*Assistant Examiner*—Harry C. Kim
*Attorney, Agent, or Firm*—Denton L. Anderson

[57] ABSTRACT

What is provided is an improved gas-powered gun for projecting lightweight projectiles, such as paint balls. Like guns presently available on the market, the gun of the invention has a handle, a barrel, a projectile chamber within the barrel, a bolt disposed within the barrel immediately rearward of the projectile chamber, a hammer disposed immediately rearward of the bolt, a spring for propelling the hammer rearwardly during the firing operation, a pressure chamber which retains a discreet amount of a pressurized gas and a valve for releasing the pressurized gas to the projectile chamber upon impact from the hammer. The improved gun of the invention differs from the gun presently on the market by the fact that the improved gun has a cocking mechanism comprising a pump handle slidably disposed around the barrel, and a bolt link slidably disposed in a longitudinal groove defined within the exterior surface of the barrel parallel with the longitudinal axis of the barrel. The bolt link is attached to the pump handle at its one end and to the bolt at its other end. Since the cocking mechanism is internalized, gun has a more "gun like" appearance and is impervious to dust and other external particles which cause damage.

1 Claim, 3 Drawing Sheets

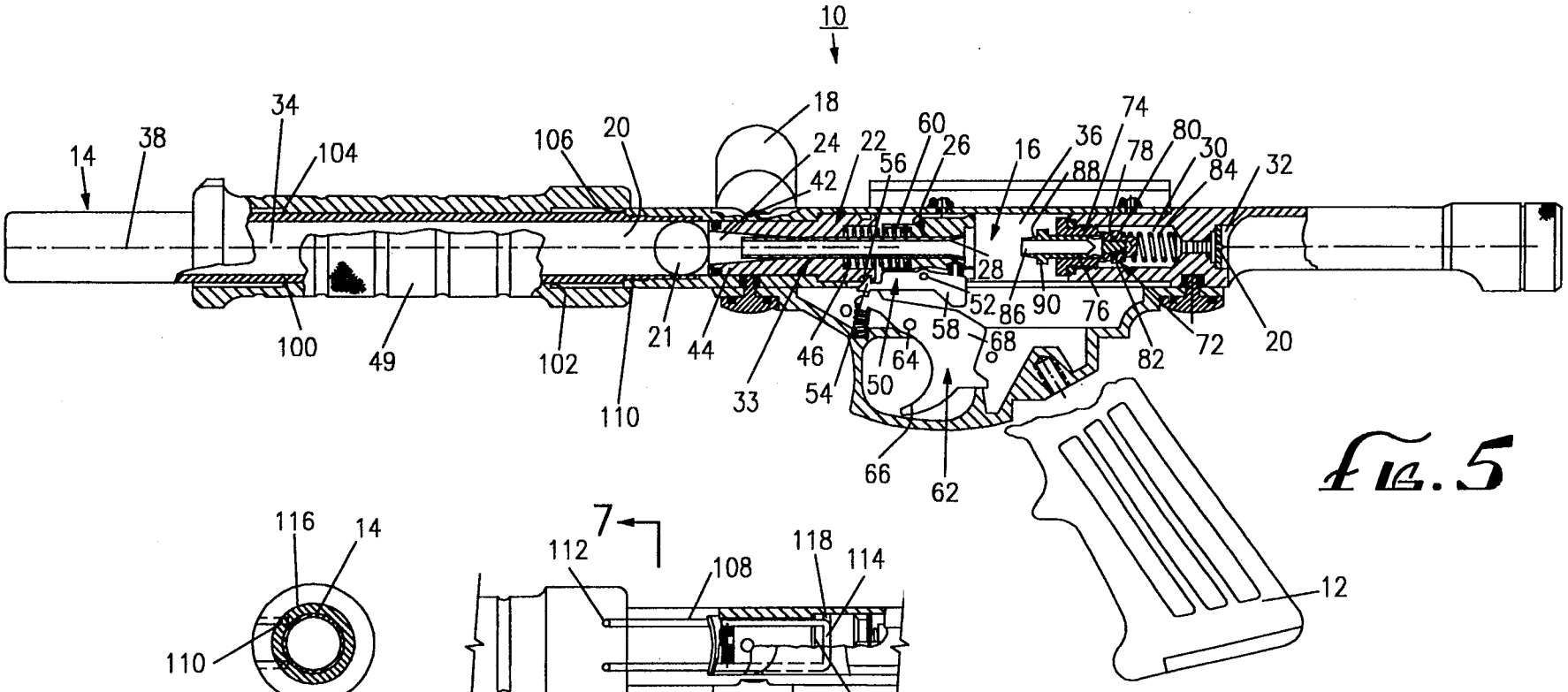
Fig. 5
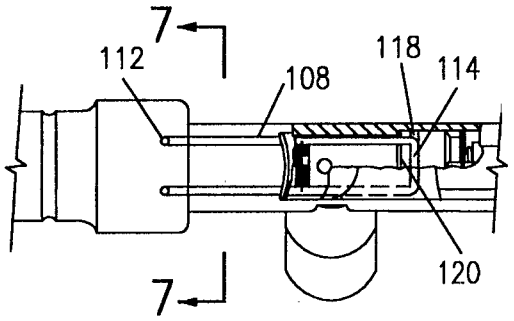
Fig. 6
Fig. 7

GAS POWERED GUN

CROSS-REFERENCES

This application is a continuation-in-part of application Ser. No. 07/916,527 filed Jul. 20, 1992, now U.S. Pat. No. 5,257,614 which is incorporated in its entirety herein by this reference.

BACKGROUND OF THE INVENTION

This invention relates generally to gas powered guns suitable for projecting lightweight projectiles, and, specifically, to gas powered guns suitable for projecting paint balls.

BACKGROUND

Gas powered guns suitable for projecting lightweight projectiles have been in existence for some time. Within the last 15 years, gas powered guns adapted to project a semi-solid ball of paint have become very popular for playing out simulated combat games among adults. Typically, the "paint balls" used in such games weigh about 0.11 ounces and are about 0.7 inches in diameter. Such simulated combat games have become highly sophisticated, organized affairs. The number of adults who regularly participate in such paint ball competitions number in the hundreds of thousands.

A very common style of paint gun presently in use is shown diagrametrically in FIGS. 1 and 2. This prior art gun comprises (I) a handle; (II) a barrel attached to the handle, the barrel having a central bore with a forward end which is in communication with the exterior of the gun, a rearward end and a longitudinal axis; (III) a projectile repository attached to the barrel; (IV) a projectile chamber disposed within the central bore of the barrel and in communication with the forward end of the central bore of the barrel; (V) projectile insertion means for removing a projectile from the projectile repository and placing it into the projectile chamber; (VI) a bolt disposed within the central bore of the barrel rearward of the projectile chamber, the bolt having a central bore which is in communication with the projectile chamber and which has a longitudinal axis which is coaxial with the longitudinal axis of the barrel; (VII) a hammer slidably disposed within the central bore of the barrel immediately rearward of the bolt, the hammer having a forward end, a rearward end and a central bore, the central bore having a longitudinal axis which is coaxial with the central bore of the barrel; (VIII) cocking means for attaching the hammer to the bolt; (IX) trigger means for detaching the hammer from the bolt; (X) a pressure chamber affixed within the rearward end of the central bore of the barrel, the pressure chamber being in communication with a source of pressurized gas; (XI) valve means affixed immediately forward of the pressure chamber for releasing a discrete quantity of pressurized gas from the pressure chamber into the central bore of the barrel; and (XII) spring means for urging the hammer away from the bolt and into contact with the valve means.

As can be seen in FIGS. 1 and 2, the prior art gun comprises bolt links slidably disposed on the external surface of the gun, the bolt links having opposite ends, the first end being attached to the external surface of the pump handle and the second end being attached to the external bolt screws. the bolt screws are in communication with the bolt through bolt link guide slots defined in the exterior of the gun such that the bolt is accessible from the exterior of the gun through the bolt link guide slots. The bolt screws are slidably disposed within the bolt link guide slots. Therefore, a sliding motion of the pump handle causes an equivalent sliding motion in the bolt links, and the motion of the bolt links in turn cause the bolt screws to slide in the bolt link guide slots moving the bolt with them.

One problem with this prior art gun is that the bolt links, disposed outside the surface of the gun, ruin the "look" of the gun. The "look" of the gun is an important feature to its users who invariably prefer a more "gun-like" appearance. Since the bolt links in most gun powder powered guns are not disposed on the exterior of the guns, the external disposition of the bolt links in the prior art gun prevent it from having a "gun-like" appearance.

In addition, since the bolt links are exposed, they are prone to damage due to external impact. Furthermore, since the bolt links protrude from the external surface of the gun, they can interfere with the effortless handling of the gun.

Another problem with this prior art gun is that the bolt link guide slots expose the interior of the gun to dust and other particles. Dust and other particles can damage the internal components of the gun leading to high repair costs and long periods of unavailability. Furthermore, frequent maintenance is required to clean out dust which invariably collects on the internal mechanisms of the gun due to their constant exposure through the guide slots.

Accordingly, there is a need for an inexpensive gas powered gun suitable for projecting lightweight projectiles in which the bolt link is not disposed on the exterior of the gun. There is a further need for such a gun wherein the bolt link guide slots do not expose the interior of the gun to external particles.

SUMMARY

The invention satisfies these needs. The invention is an improved gas powered gun suitable for projecting lightweight projectiles such as paint balls wherein the bolt links are not disposed on the exterior of the gun. Furthermore, the invention is an improved gas powered gun wherein the bolt link guide slots do not expose the internal components of the gun to external elements.

The invention is a gun comprising: (I) a handle; (II) a barrel attached to the handle, the barrel having an external surface and a central bore with a forward end which is in communication with the exterior of the gun, a rearward end and a longitudinal axis; (III) a projectile repository attached to the barrel; (IV) a projectile chamber disposed within the central bore of the barrel and in communication with the forward end of the central bore of the barrel; (V) projectile insertion means for removing a projectile from the projectile repository and placing it into the projectile chamber; (VI) a bolt disposed within the central bore of the barrel rearward of the projectile chamber, the bolt having a forward end and a rearward end central bore which is in communication with the projectile chamber and which has a longitudinal axis which is coaxial with the longitudinal axis of the barrel; (VII) a hammer slidably disposed within the central bore of the barrel immediately rearward of the bolt, the hammer having a forward end, a rearward end and a central bore, the central bore having a longitudinal axis which is coaxial with the central bore of the barrel; (VIII) cocking means for attaching the hammer to the bolt; (IX) trigger means for detaching the hammer from the bolt; (X) a pressure chamber affixed within the rearward end of the central bore of the barrel, the pressure chamber being in communication with a source of pressurized gas; (XI) gas release actuation means for actuating the valve means and releasing the discrete quantity of gas; (XII) valve means affixed immediately forward of the pressure chamber for releasing a discrete quantity of pressurized gas from the pressure chamber into the central bore of the barrel; and (XIII) spring means for urging the hammer away from the bolt and into contact with the valve means; wherein the barrel has a longitudinal groove defined within the exterior surface of the barrel parallel with the longitudinal axis of the barrel; wherein the barrel has a forward stroke limiter and a rearward stroke limiter, the two stroke limiters being spaced apart from one another; and wherein the cocking means comprises: (a) a pump handle slidably attached around the barrel, the pump handle being made from a resilient non-metallic material and having an interior surface with a forward lip and a rearward lip, the pump handle being slidable along the barrel between a first pump handle position wherein the forward lip engages the forward stroke limiter and a second pump handle position wherein the rearward lip engages the rearward stroke limiter; and (b) a bolt link slidably disposed in the groove in the external surface of the barrel, the bolt link having opposite ends, the first end being attached to the pump handle and the second end being attached to the bolt.

DESCRIPTION OF THE DRAWINGS

These and other features, aspects and advantages of the present invention will become understood with reference to the following description, appended claims and accompanying drawings, wherein:

FIG. 5 is a detailed view in partial cross-section of the gas powered gun shown in FIG. 3 wherein the hammer is in a ready-to-fire position;

FIG. 6. is a detailed partial top view of the gas powered gun shown in FIG. 5.

FIG. 7. is a detailed cross section view of the gas powered gun of FIG. 5

DESCRIPTION OF THE INVENTION

The invention is an improvement to a gas powered gun which is suitable for projecting lightweight projectiles, such as paint balls. An embodiment of the invention is shown in FIGS. 3–7.

Figure 1:
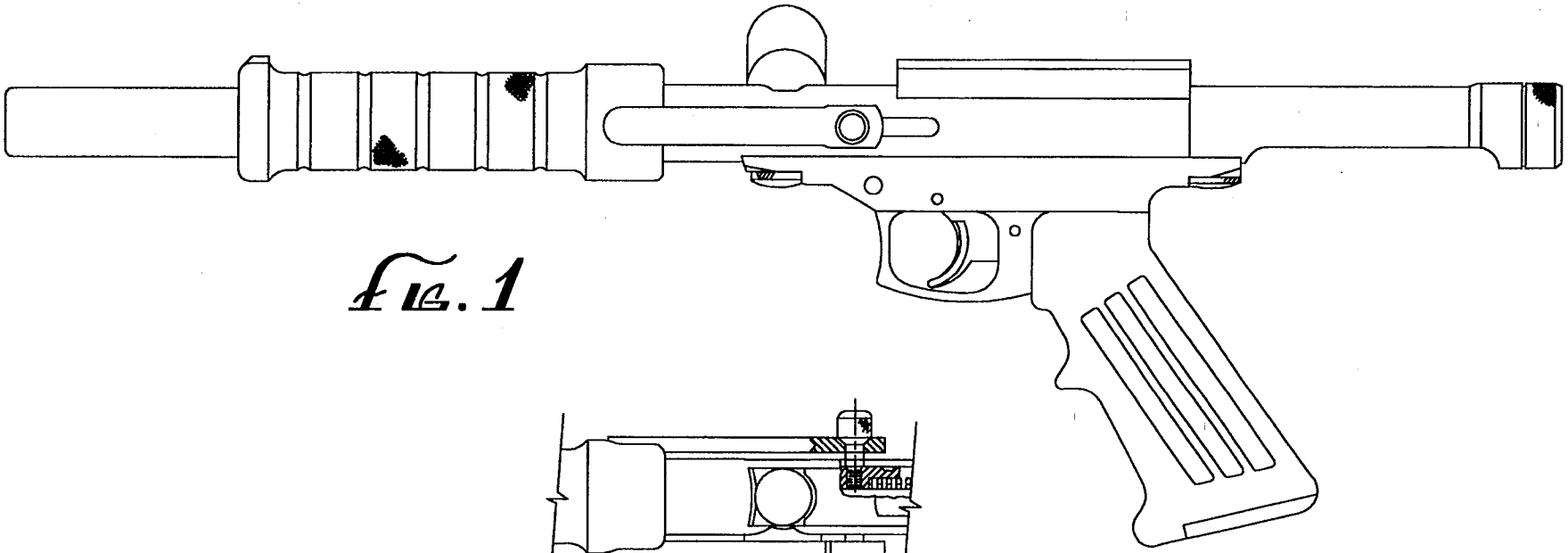
FIG. 1 is a side view of a gas powered gun of the prior art.
Figure 2:
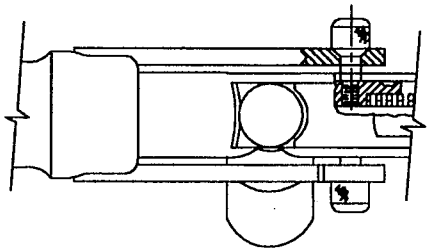
FIG. 2 is a detailed partial top view of the gas powered gun shown in FIG. 1.
Figures 3, 4:
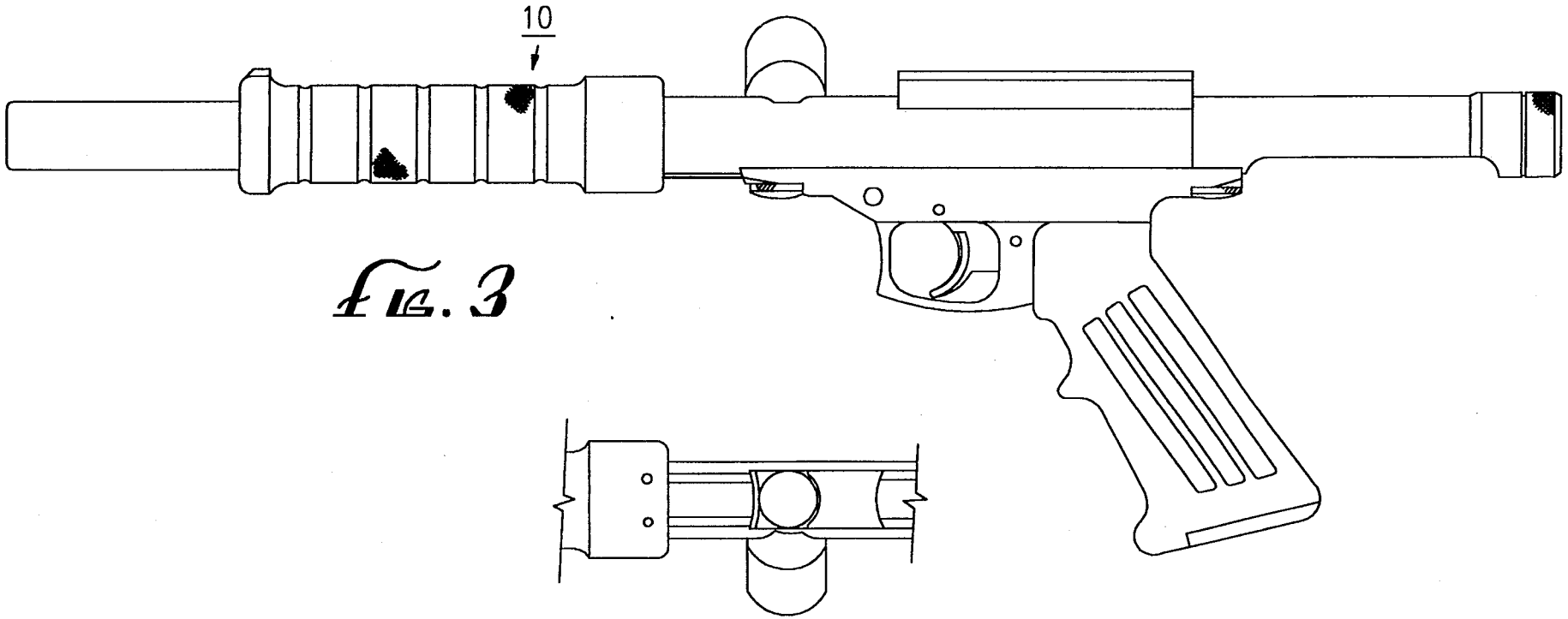
FIG. 3 is a side view of a gas powered gun having features of the invention.
FIG. 4 is a partial top view of the gas powered gun shown in FIG. 3.

As discussed in the Summary section, the gas powered gun of the invention 10 is an improvement over the prior art gas powered gun shown in FIGS. 1 and 2. Both the gun of the invention 10 and the prior art comprises: (I) a handle 12, (II) a barrel 14, having a central bore 16, (III) a projectile repository 18 attached to the barrel 14, (IV) a projectile chamber 20 disposed within the central bore 16 of the barrel 14, (V) projectile insertion means for removing a projectile 21 from the projectile repository 18 and placing it into the projectile chamber 20, (VI) a bolt 22 affixed within the central bore 16 of the barrel 14 rearward of the projectile chamber 20, the bolt 22 having a central bore 24 which is in communication with the projectile chamber 20, (VII) a hammer 26 slidably disposed within the central bore 16 of the barrel 14 immediately rearward of the bolt 22, the hammer 26 having a central bore 28, (VIII) cocking means for attaching the hammer 26 to the bolt 22, (IX) trigger means for detaching the hammer from the bolt 22, (X) a pressure chamber 30 affixed within the central bore 16 of the barrel 14, the pressure chamber being in communication with a source of pressurized gas 32, (XI) valve means affixed immediately forward of the pressure chamber 30 for releasing a discrete quantity of pressurized gas from the pressure chamber 30 into the central bore 16 of the barrel 14, and (XII) spring means for urging the hammer 26 away from the bolt 22 and into contact with the valve means.

The improvement of the invention comprises: (1) the removal of the bolt links disposed on the exterior of the prior art gun and the removal of the corresponding bolt link guide slots, and (2) addition of the longitudinal groove 110 defined within the exterior surface 116 of the barrel 14 parallel with the longitudinal axis 38 of the barrel 14, and addition of a bolt link 108 slidably disposed in the groove 110 in the external surface of the barrel 14.

In the gun of the invention 10, the handle 12 can be of any shape suitable for gripping by the user. The handle 12 can be made out of any suitable material, including metals, plastics and woods.

The barrel 14 is a hollow cylinder typically made of steel. The barrel 14 can, however, be made of other suitable materials capable of withstanding the structural and pressure forces present during cocking and firing. The central bore 16 of the barrel 14 has a forward end 34 which is in communication with the exterior of the gun 10 and a rearward end 36. The barrel 14 also has a longitudinal axis 38.

The projectile repository 18 is attached to the exterior of the barrel 14. The projectile repository 18 can be any suitable container vessel capable of holding one or more of the lightweight projectiles 21.

The projectile chamber 20 is disposed within the central bore 16 of the barrel 14. The projectile chamber 20 is in communication with the forward end 34 of the central bore 16 of the barrel 14.

The projectile insertion means for removing a projectile 21 from the projectile repository 18 and placing it into the projectile chamber 20 can be any of the many suitable insertion means known in the art. Projectile insertion means whereby a projectile 21 is urged into the projectile chamber 20 by spring means or gas pressure means can be used. In the embodiment shown in the drawings, the projectile insertion means comprises a feed tube 42 which is in communication with both the projectile repository 18 and the projectile chamber 20. The projectile repository 18 is disposed above the projectile chamber 20 so that the lightweight projectile 21 will gravitate from the projectile repository 18 to the projectile chamber 20 via the feed tube 42.

The bolt 22 is disposed within the central bore 16 of the barrel 14 rearward of the projectile chamber 20. The bolt 22 has a forward end 44 and a rearward end 46. The central bore 24 of the bolt 22 is in communication with the projectile chamber 20. The central bore 24 of the bolt 22 has a longitudinal axis which is coaxial with the longitudinal axis 38 of the barrel 14. In a preferred embodiment, the cross-sectional area of the central bore 24 of the bolt 22 in the forward end 44 of the bolt 22 is greater than cross-sectional area of the central bore 24 at the rearward end 46 of the bolt 22.

In the embodiment shown in the drawings, the bolt 22 is slidably disposed within the central bore 16 of the barrel 14, and is slidable between a first, forward-most bolt position wherein the bolt 22 blocks the communication between the feed tube 42 and the projectile chamber 20 and a second, rearward-most bolt position wherein the bolt 22 does not block the communication between the feed tube 42 and the projectile chamber 20.

The bolt 22 can be made of any suitable material, such as a plastic or a light metal.

The hammer 26 is slidably disposed within the central bore 16 of the barrel 14 immediately rearward of the bolt 22. The hammer 26 has a forward end 47 and a rearward end 48. The central bore 28 of the hammer 26 has a longitudinal axis which is coaxial with the longitudinal axis 38 of the barrel 14. The hammer 26 can be made of any suitable material having sufficient mass to actuate the valve means described below and must be made of a material strong enough to withstand the mechanical and pressure forces generated during operation. In a typical embodiment, the hammer is made out of a metal, such as a steel.

As shown in FIGS. 5 and 7, in cooperation with the cocking means, described below, the barrel 14 barrel has a longitudinal groove 110 defined within the exterior surface 116 of the barrel 14 parallel with the longitudinal axis 38 of the barrel 14. The barrel 14 also has a forward stroke limiter 104 and a rearward stroke limiter 106. The stroke limiter 104 is spaced apart from the stroke limiter 106.

The cocking means comprises a pump handle 49 disposed on the exterior of barrel 14 so as to slide along the barrel 14. The pump handle 14 has an interior surface with a forward lip 100 and a rearward lip 102. The pump handle 49 is slidable along the barrel 14 between a first pump handle position wherein the forward lip 100 engages the forward stroke limiter 104 and a second pump handle position wherein the rearward lip 102 engages the rearward stroke limiter 106.

As shown in FIGS. 5 and 6 the cocking means further comprises a bolt link 108 slidably disposed in the groove 110 in the external surface of the barrel 14. The bolt link 108 has opposite ends, the first end 112 is attached to the pump handle 49 and the second end 114 is adapted to engage a notch 118 defined by the exterior surface of the rearward end 46 of the bolt 22.

The pump handle is made from a resilient non-metallic material.

The pump handle 49 can be slid along the exterior of the barrel 14 rearwardly so that the bolt 22 is slid between the first bolt position and the second bolt position. The stroke of the pump handle 49 is determined principally by the size of the projectile 21.

The two stroke limiters can be spaced apart to limit the sliding motion of the pump handle 49 to prevent the bolt link 108 from stressing the forward edge of opening 120 as the pump handle 49 slides forward, and to similarly prevent the bolt link 108 from stressing the rear edge of the opening 120 as the pump handle 49 slides rearward.

The cocking means in the embodiment shown in the drawings further comprises a sear 50 which is swivably attached to the hammer 26 by a sear pivot 52. The sear 50 has a latch 54 which is adapted to engage a notch 56 defined by the exterior surface of the rearward end 46 of the bolt 22. When the latch 54 is engaged within the notch 56, the bolt 22 is held firmly in close proximity to the hammer 26. The sear 50 also comprises a sear cam 58 which cooperates during the firing operation with the trigger means, described below.

The spring means for urging the hammer 26 away from the bolt 22 is provided in the embodiment shown in the drawings by a hammer spring 60 disposed between the hammer 26 and the bolt 22. The hammer spring 60 is so disposed that, when the hammer 26 is attached to the bolt 22 by the sear 50, the hammer spring 60 is in compression. The hammer spring 60 can be of any suitable strength. Typically, the hammer spring 60 has a spring tension between about 3 pounds and about 12 pounds.

The trigger means for detaching the hammer 26 from the bolt 22 is provided in the embodiment shown in the drawings by a trigger 62 which is swivably attached on a trigger pivot 64. The trigger 62 is shaped with (1) a trigger projection 66 for contact with the user's finger, and (2) a trigger cam 68 which is disposed in close proximity to the sear cam 68. As can be seen from FIG. 5, when the trigger projection 66 is pulled by the finger of a user, the trigger cam 68 rotates upwardly and contacts the sear cam 58. By this action, the sear 50 is caused to rotate about the sear pivot 52 so as to cause the latch 54 to disengage from the notch 56 of the bolt 22.

The pressure chamber 30 is affixed within the rearward end 36 of the central bore 16 of the barrel 14. The pressure chamber 36 is in communication with a source of pressurized gas 32, such as a pressurized $CO_2$ canister. The pressure chamber 36 should be constructed so as to withstand at least about 300 psig., preferably 800 psig, and most preferably 2000 psig. As shown in the embodiment of the drawings, a piercing pin 70 is used to release gas from a gas canister 32 into the pressure chamber 30.

The pressurized gas can be one any of the several inexpensive, noncorrosive gases. Carbon dioxide is most typically used as a pressurized gas. Pressurized air and pressurized nitrogen can also be used.

The valve means for releasing a discreet quantity of pressurized gas from the pressure chamber 30 is affixed immediately forward of the pressure chamber 30 in the central bore 16 of the barrel 14. As shown in FIG. 5, the valve means is provided by a pressure release valve 72. The pressure release valve 72 comprises a valve seat 74, a valve tube 76 having at least one valve port 78, a sealing ring 80 and a backing nut 82. In a typical embodiment, the pressure release valve 72 has two valve ports 78, each being about 0.18 inches in diameter. Spring means, shown in the drawings as a valve spring 84, are provided to urge the backing nut 82 against the sealing ring 80 to cover and seal the ports 78. Typically, the valve spring 84 exerts between about 3 and about 12 pounds of force.

The gas release actuation means for actuating the valve means and releasing a discreet quantity of gas from the pressure chamber comprises a gas release tube 86 for receiving the discreet quantity of pressurized gas. The gas release tube 86 is affixed to the valve tube 76 between the valve tube 76 and the hammer 26. Alternatively, as shown in the embodiment in the drawings, the valve tube 76 and the gas release tube 86 are one and the same continuous structure. The gas release tube 86 has a longitudinal axis which is coaxial with the longitudinal axis 38 of the central bore 16 of the barrel 14. The gas release tube 86 also has a hammer engagement surface 88 for engaging and cooperating with the rearward end 48 of the hammer 26. In the embodiment shown in the drawings, the hammer engagement surface 88 is provided by a shoulder 90 defined on the external surface of the gas release tube 86.

The gas release tube 86 is disposed within the valve means in such a way that, when the rearward end 48 of the hammer 26 is driven rearwardly within the central bore 16 of the barrel 14 by the force of the spring means, the kinetic energy of the hammer 26 is transferred to the gas release tube 86 by the engagement of the rearward end 48 of the hammer 26 and the hammer engagement surface 88.

Accordingly, when the gun 10 is fired and the hammer 26 is urged rearwardly into contact with the hammer engagement surface 88, the gas release tube 86 presses rearwardly against the valve tube 76. This pressure tends to open the ports 78 by pushing the sealing ring 80 and the backing nut rearwardly against the counteracting pressure of the spring means. As the ports 78 are opened, a discreet quantity of pressurized gas stored within the pressure chamber 30 is released through the ports 78.

In the embodiment shown in FIG. 5., a guide tube 33 can be made from any suitable material which can withstand the forces associated with continual sliding contact with the interior surface of the central bore 24 of the bolt 22. In a typical embodiment, the gas release tube is made of a steel and the combined mass of the hammer 26, sear 50, and guide tube 33 is between about 2 and 3 ounces, preferably between about 1.5 and about 1.9 ounces.

The guide tube 33 is adapted to slide smoothly within the central bore 24 of the bolt 22. Preferably, the exterior surface of the guide tube 33 is dimensioned to be in close tolerance with the central bore 24 of the bolt 22. In a most preferred embodiment, the exterior surface of the guide tube is cylindrical as is the central bore 24 of the bolt 22 and the difference between the outside diameter of the guide tube 33 and the inside diameter of the central bore 24 of the bolt 22 is less than about 0.01 inches, most preferably between about 0.002 inches and 0.005 inches.

Where the exterior surface of the guide tube 33 is cylindrical, the length of the guide tube 33 should be at least twice the outside diameter of the guide tube 33.

In a typical embodiment, the interior surface of the guide tube 33 is cylindrical and has a diameter between about 0.12 inches and about 0.22 inches. Also in a typical embodiment, the exterior surface of the guide tube 33 is cylindrical and has an outside diameter of between about ⅜ of an inch and 11/16 of an inch.

In a preferred embodiment, the guide tube 33 is disposed within the central bore 28 of the hammer 26.

FIG. 5 shows the gun 10 in the ready-to-fire position with a lightweight projectile 21 disposed within the projectile chamber 20. The hammer 26 is attached to the bolt 22 by the sear 50. The hammer spring 60 is in compression. When the trigger projection 66 is pulled rearwardly by the user, the trigger 62 rotates around the trigger pivot 64 causing the trigger cam 68 to engage the sear cam 58. This action causes the sear 50 to rotate about the sear pivot 52 disengaging the latch 54 from the notch 56. The hammer 26 is thereby released from the bolt 22 and the hammer spring 60 urges the hammer 26 rearwardly toward the gas release tube 86. As the rearward end 48 of the hammer 26 contacts the hammer engagement surface 88 of the gas release tube 86, the gas release tube 86 is urged rearwardly against the counterpressure exerted by the valve spring 84. This action causes the sealing ring 80 to be displaced rearwardly away from the valve ports 78 so that pressurized gas within the pressure chamber 30 is released through the valve port 78 and into the valve tube 76. A pressure wave is thereby caused to propagate through the valve tube 76, through the gas release tube 86, through the guide tube 33, through the central bore 24 of the bolt 22 and into the projectile chamber 20. This pressure energy is imparted to the lightweight projectile 21 which is thereby urged forwardly out through the forward end 34 of the central bore 16 of the barrel 14.

As can be seen from a comparison of FIG. 1 and FIG. 5, the improved gun of the invention 10 differs principally from the prior art gun of FIG. 1. by the fact that the bolt links disposed on the exterior of the prior art gun and the corresponding bolt link guide slots have been replaced by the groove 110 defined within the exterior surface 116 of the barrel 14 parallel with the longitudinal axis 38 of the barrel 14, and addition of a bolt link 108 slidably disposed in the groove 110 in the external surface of the barrel 14.

The groove 110 does not expose the interior of the gun to dust or other external elements. Furthermore, the bolt link 108 is disposed in the groove 110 and not on the exterior surface of the gun. As a result the gun of the invention 10 has the much desired "gun like" appearance.

Although the present invention has been described in considerably detail with reference to certain preferred versions, many other versions should be apparent to those skilled in the art. Therefore, the spirit and scope of the appended claims should not necessarily be limited to the description of the preferred versions contained therein.

What is claimed is:

1. An improved gas powered gun suitable for projecting light weight projectiles such as paint balls, the gun comprising:

(I) a handle;

(II) a barrel attached to the handle, the barrel having an external surface and a central bore with a forward end which is in communication with the exterior of the gun, a rearward end and a longitudinal axis;

(III) a projectile repository attached to the barrel;

(IV) a projectile chamber disposed within the central bore of the barrel and in communication with the forward end of the central bore of the barrel;

(V) projectile insertion means for removing a projectile from the projectile repository and placing it into the projectile chamber;

(VI) a bolt disposed within the central bore of the barrel rearward of the projectile chamber, the bolt having a forward end and a rearward end central bore which is in communication with the projectile chamber and which has a longitudinal axis which is coaxial with the longitudinal axis of the barrel;

(VII) a hammer slidably disposed within the central bore of the barrel immediately rearward of the bolt, the hammer having a forward end, a rearward end and a central bore, the central bore having a longitudinal axis which is coaxial with the central bore of the barrel;

(VIII) cocking means for attaching the hammer to the bolt;

(IX) trigger means for detaching the hammer from the bolt;

(X) a pressure chamber affixed within the rearward end of the central bore of the barrel, the pressure chamber being in communication with a source of pressurized gas;

(XI) valve means affixed immediately forward of the pressure chamber for releasing a discrete quantity of pressurized gas from the pressure chamber into the central bore of the barrel;

(XII) gas release actuation means for actuating the valve means and releasing the discrete quantity of gas; and (XIII) spring means for urging the hammer away from the bolt and into contact with the valve means;

wherein the barrel has a longitudinal groove defined within the external surface of the barrel parallel with the longitudinal axis of the barrel;

wherein the barrel has a forward stroke limiter and a rearward stroke limiter, the two stroke limiters being spaced apart from one another; and wherein the cocking means comprises:

(a) a pump handle slidably attached around the barrel, the pump handle being made from a resilient non-metallic material and having an interior surface with a forward lip and a rearward lip, the pump handle being slidable along the barrel between a first pump handle position wherein the forward lip engages the forward stroke limiter and a second pump handle position wherein the rearward lip engages the rearward stroke limiter; and (b) a bolt link slidably disposed in the groove in the external surface of the barrel, the bolt link having opposite ends, the first end being attached to the pump handle and the second end being attached to the bolt.

* * * * *